United States Patent [19]

Eventoff et al.

[11] 4,276,538

[45] Jun. 30, 1981

[54] TOUCH SWITCH KEYBOARD APPARATUS

[75] Inventors: Franklin N. Eventoff, 2351 Lakeview, Los Angeles, Calif. 90039; Serge A. Tcherepnin, San Francisco, Calif.

[73] Assignee: Franklin N. Eventoff, Los Angeles, Calif.

[21] Appl. No.: 110,416

[22] Filed: Jan. 7, 1980

[51] Int. Cl.[3] ..... H01C 10/00

[52] U.S. Cl. ..... 338/69; 84/DIG. 7

[58] Field of Search ..... 338/69, 99, 114, 110, 338/153; 84/DIG. 7, 1.25, 1.24, 1.01

[56] References Cited

U.S. PATENT DOCUMENTS

| | | | |
|---|---|---|---|
| 3,624,584 | 11/1971 | Ohno | 338/69 |
| 3,626,350 | 12/1971 | Suzuki | 338/69 |
| 3,960,044 | 6/1976 | Nagai et al. | 84/1.01 |
| 4,079,651 | 3/1978 | Matsui | 84/DIG. 7 X |

FOREIGN PATENT DOCUMENTS 1520899 8/1978 United Kingdom .

*Primary Examiner*—C. L. Albritton

*Attorney, Agent, or Firm*—Nilsson, Robbins, Dalgarn, Berliner, Carson & Wurst

[57] ABSTRACT

A multiple touch switch apparatus has at least one multiple segment conductor ply on the top surface of a support ply. The segments are electrically insulated from each other by their lateral displacement but are immediately adjacent so that a selected one or more of the segments can be contacted in response to a single transverse touch force. A second support ply has a unitary conduction ply on its bottom surface spaced apart from, but facing, the multiple segment conductor ply. At least the second support ply and the unitary conduction ply are resilient deformable into contact with one or more segments of the multiple segment conductor ply. Each of the multiple segment conductors or the unitary conduction ply or both may incorporate a conductor layer and a pressure sensitive semiconductor composition layer disposed thereon. The semiconductor layer provides a pressure sensitive variable contact resistance in series with the switch. In another embodiment, each multiple segment conductor ply may be replaced by a single segment conductor.

19 Claims, 4 Drawing Figures

TOUCH SWITCH KEYBOARD APPARATUS

BACKGROUND OF THE INVENTION

The present invention relates to switches and in particular relates to multiple switches with a unitary contact layer operating as a collection bus and which further comprises multiple conductor segments, each representative of a different switch, which are singly or collectively operable by the application of a single transverse touching force to thereby perform multiple switching using the single applied touching force.

Touch switch devices have been known and are incorporated to effect switching in numerous types of electronic instruments. One type of device in which touch switches may be used to particular advantage are musical instruments and specifically keyboards for those musical instruments. The novel multiple switch device of the present invention may be used to provide either a chord keyboard or a single note keyboard.

In the chord keyboard, a number of chord switches are provided in a keyboard arrangement so that when a chord switch is depressed one or more musical notes will be generated. Each chord switch is fabricated by providing several individual electrically isolated touch switches which are oriented in close proximity so that the application of one touch force will cause several of the individual electrically isolated touch switches to be closed. One feature of the invention is that at least several of the chord switches (and hence individual electrically isolated switches comprising each chord switch) have a common switch contact. This common switch contact also provides an output bus on which two or more different signals are combined when the individual switches are closed. This dual function is made possible by the incorporation of a semiconductor composition layer between the two contacts (one of which is common to several other switches) and one of which is electrically separate from the corresponding contacts of the other switches of each individual switch.

Another significant advantage of the present invention is that a multi-musical note chord can be generated by applying but a single transverse touch force. Thereafter that chord can be altered by the addition or deletion of one or more notes simply by rolling or rotating the finger to alter the location at which the transverse touching force is applied. This causes one or more individual electrically isolated switches of the chord switch to be opened or closed. In order to accomplish this function, individual segments representing separate contacts for the individual switches are provided on each chord switch structure. These segments are then positioned in relatively close but non-contacting relationship so that the application of a single touching force effectively closes all of the switches by bringing an upper unitary conductive layer into electrical contact with each of the individual conductor segments. A different signal is coupled to each segment. These signals are then coupled through a resistive layer and are combined on the unitary conductor conductive layer (second contact for the switches).

The particular chord may be easily changed or other wise altered by the musician by simply rolling the finger which is applying the transverse touch force. This finger roll action operates to either bring the unitary first conductive layer into electrical contact with additional segments or to break the contact between the unitary conductive layer and one or more of the previously contacted segments.

SUMMARY OF THE INVENTION

A multiple touch switch apparatus includes at least one chord switch which may be actuated by the application of a single transverse touch force. The multiple touch switch comprises a first support ply having a to surface on which is disposed a multiple segment conduction ply for each chord switch. Each multiple segment conduction ply comprises a plurality of first electrically isolated conductors immediately adjacent to but laterally displaced from one another. The surface area of each such conductor is selected so that one or more of the first electrically isolated conductors is simultaneously contacted in response to the application of a single transverse touch force.

The multiple touch switch apparatus also has a second support ply on whose bottom surface a unitary conduction ply is positioned facing but transversely spaced from the multiple segment conduction ply. The unitary conduction ply is resiliently deformable into electrical contacting relationship with at least a selected one of the multiple segment conduction plies in response to the application of a transverse touching force. In the preferred embodiment, the unitary conduction ply comprises a unitary conductive layer positioned on the bottom surface of the second support ply and a first semiconductor composition layer positioned for covering the unitary conductive layer and facing at least one multiple segment conduction ply. Finally, a transverse spacer is positioned laterally between each multiple segment conductor ply and transversely between the first and second support plies for spacing the unitary conduction ply from the multiple segment conduction plies.

The first electrically isolated conductors may each further comprise a conductive layer positioned on the top surface of the first support ply and a second semiconductor composition layer positioned on the first conductive layer facing the unitary conduction ply.

BRIEF DESCRIPTION OF THE DRAWINGS

A complete understanding of the present invention and of the above and other advantages thereof may be gained from a consideration of the following description of the preferred embodiments taken in conjunction with the accompanying drawings in which.

DETAILED DESCRIPTION

The present invention comprises a multiple touch switch apparatus which may be used in any one of a number of applications but which is particularly useful in providing a touch keyboard for an electronic musical instrument. In view of this particular usage of the invention, the following description will be made in reference to the electronic generation of musical notes in a musical instrument. However, it will be appreciated that the invention has application to many other devices in which a keyboard-like switch apparatus is required.

The multi-switch apparatus of the present invention may incorporate a pressure sensitive resistive layer as disclosed in my patent application, Ser. No. 78,323 filed Sept. 9, 1979, herein incorporated by reference, or may incorporate the multi-stacked switch device disclosed in my patent application, Ser. No. 97,610 filed on Nov. 26, 1979 which is also herein incorporated by reference.

The novel multiple touch switch apparatus of the present invention may also incorporate a signal combination capability whereby one conductor plate of the switch apparatus may perform the function of combining two or more signals, each having different frequencies, to thereby gene rate a multi-frequency musical chord.

Figure 1:
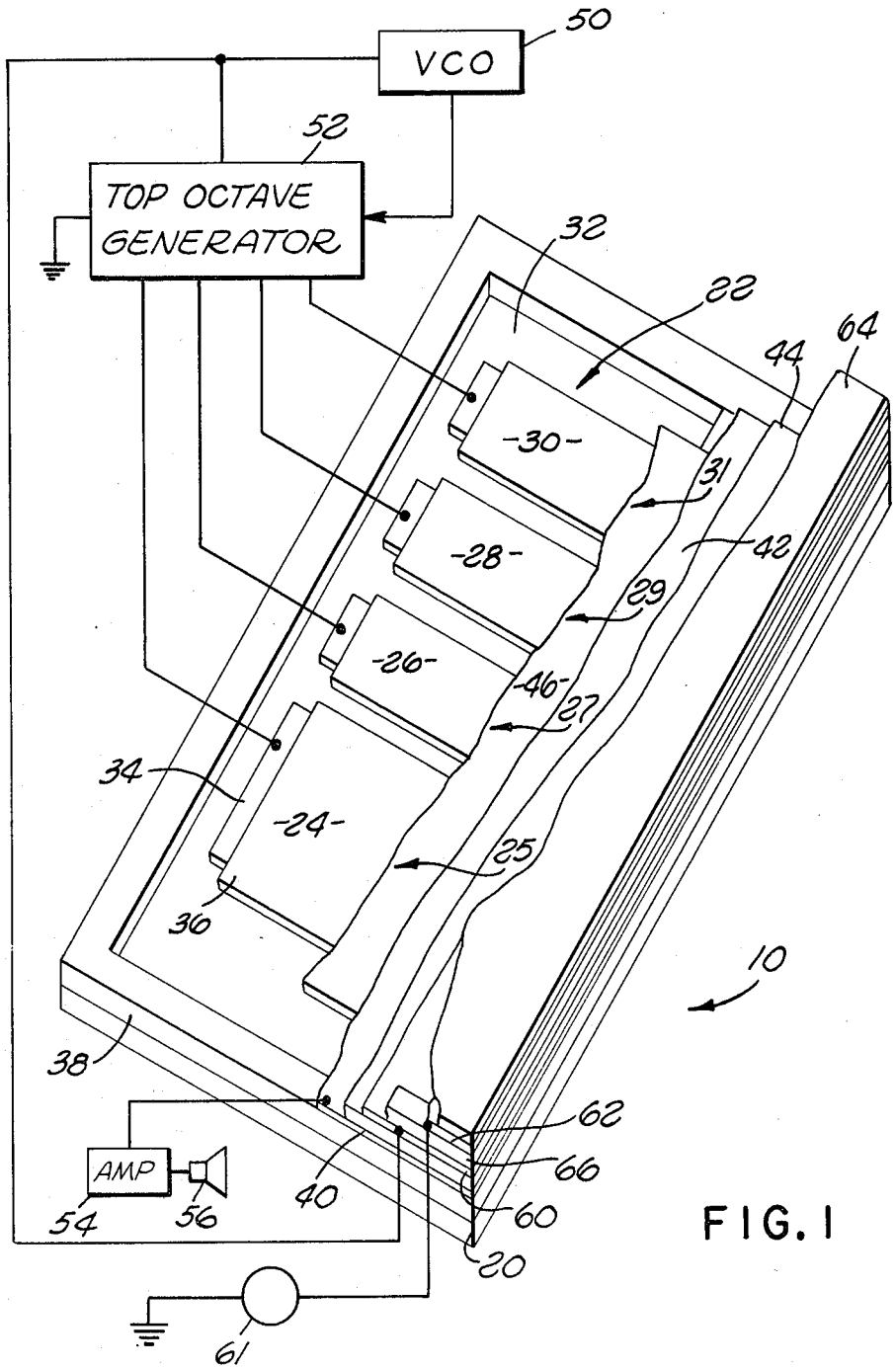
FIG. 1 is a partiual schematic, partial cutaway perspective view illustrating one chord switch structure in accordance with the present invention.

Referring first to FIG. 1, a partial cutaway view of a multiple touch switch apparatus 10 which is useful in generating a chord in response to the application of a single transverse touching force is illustrated. The multiple touch switch functionally comprises a plurality of individually electrically isolated switches grouped in sets of two or more. Each such set comprises a chord switch. A plurality of chord switches is arranged side by side to form a keyboard for the multiple touch switch apparatus 10. Specifically, the multiple touch switch apparatus 10 comprises a first support ply 20 which may be made of a rigid plastic insulative material or may be made of a resiliently deformable material such as Mylar. A plurality of multi-segment conduction plies 22, each representing a separate chord switch comprises four first electrically isolated conductors, e.g., conductors 24, 26, 28, and 30, each representing one pole or contact of the individually electrically isolated switches, 25, 27, 29, and 31, respectively, are then attached or otherwise fixed to the top surface 32 of the first support ply 20. In the embodiment of the invention in which a chord may be generated upon application of a single transverse touch force, the several first electrically isolated conductors 24, 26, 28, and 30, are positioned in sufficiently close lateral proximity to each other so that when an operator's finger is pressed against the multiple touch switch apparatus 10, the top surfaces of the several first electrically isolated conductors, 24, 26, 28, and 30 can be contacted to thereby simultaneously close all of the electrically isolated switches 25, 27, 29, and 31 to generate a chord.

Although each of the first electrically isolated conductors, 24, 26, 28, and 30 may be a single layer made of a purely conductive material such as a layer of silver, copper, or other similar conductive material, in the preferred embodiment, each of the first electrically isolated conductors comprises two layers; a conductive layer which is attached to the top of the first support ply 20 and a first semiconductor composition layer which is sprayed, silk screened, electrostatically plated, vacuum deposited, or otherwise disposed to form a very thin layer of semiconductor material which covers the entire conductive layer.

By way of example, in accordance with this preferred embodiment, the first electrically isolated conductor 24 comprises a first conductive layer 34 on top of which a first semiconductor composition layer 36 is disposed by spraying, silk screening or any other suitable method.

In the preferred embodiment, each of the first electrically isolated conductors 24, 26, 28, and 30 are laterally spaced apart from one another to provide the necessary electrical isolation. Insulative spacers are not used between the first electrically isolated conductors which comprise a single chord switch so that a smooth transition between one chord and another chord having either added or deleted notes, can be achieved without "clicking" by simply "rolling" the operator's finger along the surface of the touch switch 10 to make or break contact with one or more of the first electrically isolated conductors. On the other hand, an insulative transverse spacer is provided to surround each multi-segment conduction ply 22, i.e., each chord switch. For example, in the embodiment of FIG. 2, a plurality of sets of individual electrically isolated switches, one for each chord to be generated, is disposed on the top surface 32 where each such set of electrically isolated switches is surrounded by a transverse spacer 38.

The multiple touch switch apparatus 10 further comprises a second support ply 44 having a bottom surface 40 on which a unitary conductive layer 42, common to all chord switches, is attached. The unitary conductive layer 42 may also be a copper or silver layer which is preferably applied by plating, spraying, electrostatic plating or any other suitable technique by which a thin conductive layer may be affixed to the bottom surface 40 of the second support ply 44.

Preferably, although not necessarily, a second semiconductor composition layer 46 is affixed by spraying, silk screening or the like to the otherwise exposed surface of the unitary conductive layer 42. The resultant structure, comprising the second support ply 44, the unitary conductive layer 42, and the semiconductor composition layer 46 is then attached by gluing by suitable mechanical attachment or by any other method to the transverse spacer 38 so that the semiconductor composition layer 46 is juxtaposed transversely opposite to and spaced apart from the semiconductor composition layers of the chord switches.

The second support ply 44, the unitary conductive layer 42 and the semiconductor composition layer 46 are resiliently deformable so that when the operator presses his finger against the multiple touch switch apparatus 10, the second support ply 44 resiliently deforms to force the semiconductor composition layer 46 into an electrically contacting relationship with one or more of the semiconductor composition layers of one of the several sets of firstr electrically isolated conductors such as conductors 24, 26, 28, and 30.

It will be appreciated, therefore, that each of the electrically isolated switches such as the switches 25, 27, 29 and 31 which represent one chord switch perform a separate switching function but that all or a selected number of those switches may be closed in response to the application of a single transverse touching force.

By way of illustration of the interconnection of the switch apparatus 10 of FIG. 1, a voltage controlled oscillator (VCO) 50 which generates a single high frequency signal, is coupled to a top octave generator 52, well known in the art, which incorporates, for example, frequency divider circuitry to generate a plurality of output signals, each having a different frequency, on one of a plurality of output leads. In order to generate a chord utilizing the abovedescribed multiple touch switch apparatus 10, it is merely necessary to select four notes and thereafter identify the particular frequency of those musical notes. The ouput lead from the top octave generator 52 having that frequency, is then coupled to one of the first conductive layers of the first electrically isolated conductors 24, 26, 28, or 30. Similarly, the remaining first conductive layers of the first electrically isolated conductors are coupled to the appropriate output of the top octave generator 52 having an output signal with the remaining selected frequencies. Hence, when a transverse touching force is applied to the multiple touch switch apparatus 10, the semiconductor composition layer 46 will be pressed into contact with one or more of the semiconductor composition layers of the first electrically isolated conductors 24, 26, 28, or 30, to thereby couple one or more signals each with a different frequency, to the unitary conductive layer 42 where those signals are combined and outputted to an amplifier 54 and is thereafter audibilized by a speaker 56.

In the preferred embodiment of the invention, the first electrically isolated conductor 24 has its conductive layer 34 coupled to the frequency output of the top octave generator 52 having the frequency of the base note of the chord. In addition, in order to allow the base note of the chord to be more easily played alone, the first electrically isolated conductor 24 is provided to be of a greater width than the remaining first electrically isolated conductors 26, 28, and 30.

It will be apparent from the above description therefore, that if an operator desires to play a chord having four notes of different frequencies, it is necessary simply to apply a single transverse touching force at a location which will cause the first semiconductor layer 46 to contact each of the first electrically isolated conductors 24, 26, 28, and 30. If the operator wishes to delete a note from the chord, it is merely necessary for the operator to roll his finger slightly to thereby open one or more of the individual electrically isolated switches by releasing the transverse touching force; the contact betwen the semiconductor composition layer 46 and one or more of the semiconductor composition layers on the first electrically isolated conductors 24, 26, 28, and 30 is opened when the touching force is released because of the resiliency of the second support ply 44.

While the above description has been made with reference to four first electrically isolated conductors 24, 26, 28, and 30, it will be appreciated that any number of individual electrically isolated switches may be utilized for each chord switch without departing from the present invention. Furthermore, several chord switches may be placed side by side in keyboard arrangement to allow the operator to play several different selected chords either alone or together. When several chord switches are so placed in a side by side keyboard-type arrangement, it will be appreciated that the previously described second support ply 44, the unitary conductive layer 42 and the semiconductor composition layer 46 will preferrably be the same for all of the chord switches comprising the keyboard.

The multiple touch switch apparatus 10 may also be provided with a single ON/OFF switch which is stacked in a laminate-like configuration to the aforedescribed keyboard switch arrangement. For example, in FIG. 1, a first ON/OFF switch conductor 60 is disposed over the top surface of the second support ply 44 and a second ON/OFF switch conductor 62 is disposed over the bottom surface of a third support ply 64 to face the first ON/OFF switch conductor 60. The first ON/OFF switch conductor 60 and the second ON/OFF switch conductor 62 are then spaced from one another in a normally open switch configuration by a spacer 66 which may, for example, comprise a rectangularly cross-sectionted strip which is glued or otherwise affixed betwen the second support ply 44 and the third support ply 64. The particular function and operation of this multi-stacked switch configuration is disclosed in application Ser. No. 97610, filed Nov. 26, 1979, which is incorporated herein by reference.

In one use of the ON/OFF switch function, the ON/OFF switch is coupled between a voltage source 61 and the VCO and the top octave generator. Hence unless the keyboard is depressed to close at least one of the chord switches, no power will be supplied to and none will be by the VCO or by the top octave generator.

Figure 2:
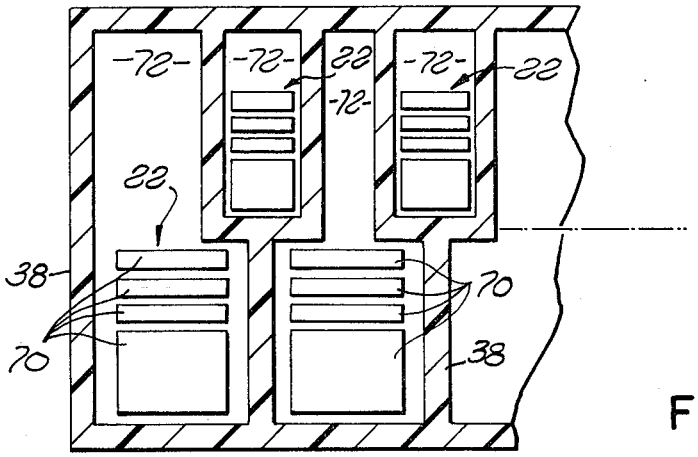
FIG. 2 is a simplified top view of a chord keyboard with the top plies removed illustrating individual segments of a plurality of chord switches.

Referring now to FIG. 2, a top cutaway view of a plurality of chord switches 72 each with a set 22 of four first electrically isolated conductor 70, is illustrated. As previously discussed, each of the electrically isolated conductors 70 represents an individual switch which is coupled to one frequency output from a top octave generator 52 illustrated in FIG. 1. When an individual electrically isolated switch is closed by contacting the conductor 70 with the semiconductor composition layer 46, (FIG. 1), a signal from the top octave generator is coupled through the smiconductor layer and then combined on the first conductive layer 42 (FIG. 1) with other signals from the top octave generator having different frequencies.

Figure 3:
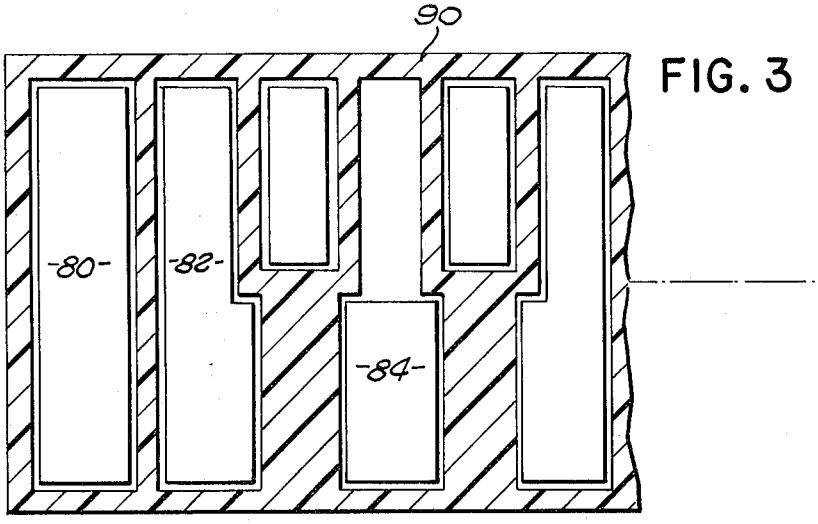
FIG. 3 is a top view of the arrangement of several electrically contiguous conductors utilized in a single note keyboard configuration in accordance with the invetion.

Referring now to FIG. 3, another embodiment of the invention is illustrated wherein each multi-segment conduction ply 22 of FIG. 1 comprises a single electrically contiguous conductor rather than four electrically isolated conductors. In such a configuration, a touch sensitive single note keyboard may be provided by interconnecting each electrically continguous conductor to a different successive frequency output from a top octave generator such as the top octave generator 52 shown in FIG. 1. More specifically, in FIG. 3, a plurality of electrically contiguous conductors 80, 82, and 84 are shown, each being surrounded by a transverse spacer 90 to maintain the respective touch switches in a normally opened configuration.

Figure 4:
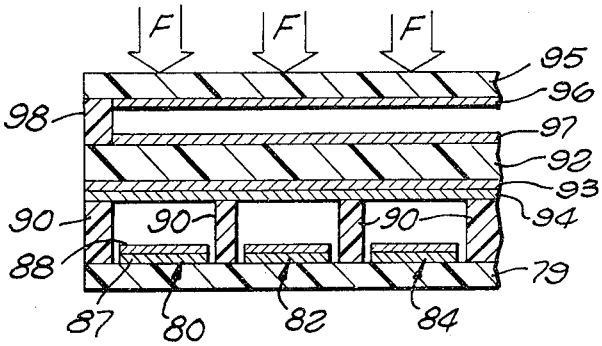
FIG. 4 is a cross-section of the several electrically contiguous conductors for the single note keyboard of FIG. 3.

Referring to FIG. 4, a cross-section of the multi-switch apparatus illustrated in FIG. 3 is shown where the electrically contiguous conductors 80, 82, and 84 are disposed on a first support ply 79 with the first transverse spacer 90 positioned on the first support ply between each of the plurality of electrically contiguous conductors 80, 82, and 84.

The electrically contiguous conductor 80 has a conductive layer 87 positioned on the top surface of the first support ply 79 and a semiconductor composition layer 88 disposed to cover the top surface of the conductive layer 87.

A second support ply 92 having a lower surface, to which a conductive layer 93 and a semiconductor composition layer 94 are sequentially affixed, is then attached across the top of the first transverse spacer 90 so as to be juxtaposed opposite the plurality of individual electrically contiguous conductors 80, 82, and 84, in the manner previously described.

The multi-switch apparatus of FIG. 4 may also incorporate an additional ON/OFF switch device in stacked configuration. The ON/OFF switch device may be fabricated by providing a conductive layer 97 on the top surface of the second support ply 92 and further providing a third support ply 95 with a fourth conductive layer 96 on its lower surface facing the third conductive layer 97, but spaced therefrom by a second transverse spacer 98.

The various semiconductor composition layers heretofore described may be made of a binder and molybdenum disulfide which provides for a pressure sensitive variable resistance across the switch contact to thereby incorporate a pressure sensitive variable resistance in series with the switch. Such a capability permits a musician operator to vary the touching pressure to a slight extent to produce a tremullo or vibrato effect to the audibilized tone.

While specific embodiments of the present invention have been described, it will be appreciated that various other modifications and alterations may be made without departing from the true spirit and scope of the invention. Consequently, it is the object of the claims to encompass all such modifications as fall within the true spirit and scope of the invention.

What is claimed is:

1. A multiple touch switch apparatus for being selectively actuated in response to the application of at least one transverse force comprising:

a first support ply having a top surface;

at least one multiple segment conductor ply positioned on the top surface of the first support ply, comprising:

a plurality of first electrically isolated conductor segments immediately adjacent but laterally displaced from one another and having a surface area whereby at least a selected one of the first electrically isolated conductor segments is simultaneously contacted in response to the application of a single transverse touch force;

a second support ply having a top surface and a bottom surface;

a unitary conduction ply positioned on the bottom surface facing and transversely spaced from the at least one multiple segment conduction ply, the second support ply and unitary conduction ply being resiliently deformable for deforming the unitary conduction ply into electrical contacting relationship with at least one selected multiple segment conductor ply in response to the application of the transverse force, the unitary conductor ply comprising:

a first conductive layer positioned on the bottom surface of the second support ply, and a first semiconductor composition layer positioned on the first conductive layer for facing the at least one multiple segment conductor ply; and a transverse spacer positioned laterally between each multiple segment conductor ply and transversely between the first and second support plies for spacing the unitary conduction ply from the at least one multiple segment conductor ply.

2. The multiple touch switch apparatus of claim 1 wherein each first electrically isolated conductor segment comprises:

a second conductive layer positioned on the top surface of the first support ply; and, a second semiconductor composition layer positioned on the second conductive layer for facing the unitary conduction ply.

3. The multiple touch switch apparatus of claims 1 or 2 wherein at least one of the first electrically isolated conductor segments in each multiple segment conductor ply has a surface area larger than the surface area of the other first electrically isolated conductor segments.

4. The multiple touch switch apparatus of claims 1 or 2 further comprising:

a first conductor ply affixed to the top surface of the second support ply.

a third support ply having a bottom surface;

a second conductor ply affixed to the bottom surface of the third support ply, facing and transversely spaced from the first conductor ply, the third support ply and the second conductor ply being resiliently deformable for deforming the second conductor ply into electrical contacting relationship with the first conductor ply in response to the application of a transverse force against the third support ply.

5. A multiple touch switch apparatus for being selectively actuated in response to the application of at least one transverse force comprising:

a first support member having a top surface;

at least one multiple segment conductor ply positioned on the top surface of the first support member comprising:

a plurality of first electrically isolated conductor segments immediately adjacent but laterally displaced from one another and having a surface area whereby at least a selected one of the first electrically isolated conductor segments is simultaneously contacted in response to the application of the single transverse touch force;

a second support member having a top surface and a bottom surface;

a first conductor layer positioned on the bottom surface of the second support member and having a plurality of conducting regions, each region being juxtaposed opposite one of the first electrically isolated conductor segments;

a resistor network for being electrically interconnected between the juxtaposed first electrically isolated conductor segments and conducting regions of the first conductor layer when the transverse force is applied to the second support member, the second support member and the first conductor layer being resiliently deformable in response to the application of the transverse force;

transverse spacer means positioned laterally between each multiple segment conductor ply and transversely between the first and second support members for spacing the first conductor layer from the multiple segment conductor plies.

6. The multiple touch switch apparatus of claim 5 wherein the resistor network comprises a plurality of resistors, each conducting region of the first conductor layer being electrically interconnected to the other conducting regions through at least one of the plurality of resistors.

7. The multiple touch switch apparatus of claim 5 wherein the first conductor layer comprises a unitary conduction ply with the conducting regions being electrically contiguous and the resistor network comprises a semiconductor composition layer positioned on the first conductor layer facing the at least one multiple segment conductor ply.

8. The multiple touch switch apparatus of claim 5 wherein the first conductor layer comprises a unitary conduction ply with the conducting regions being electrically contiguous and the resistor network comprises a semiconductor composition layer positioned on the at least one multiple segment conductor ply.

9. The multiple touch switch apparatus of claim 7 or 8 wherein the semiconductor composition layer is pressure sensitive for providing a variable resistance across the semiconductor composition layer in response to variations in the applied transverse force.

10. The multiple touch switch apparatus of claim 5 or 6 wherein at least one of the first electrically isolated conductor segments of each multiple segment conductor ply has a surface area larger than the surface area of the other first electrically isolated conductor segments.

11. The multiple touch switch apparatus of claims 5 or 6 further comprising:

a first conductor ply affixed to the top surface of the second support member;

a third support member having a bottom surface;

a second conductor ply affixed to the bottom surface of the third support member, facing and transversely spaced from the first conductor ply, the third support member, and the second conductor ply being resiliently deformable for deforming the second conductor ply into electrical conducting relationship with the first conductor ply in response to the application for a transverse force and the third support member.

12. A multiple touch switch apparatus for being selectively activated in response to the application of at least one transverse force comprising:

a first support member having a top surface;

a plurality of first electrically isolated conductor segments laterally displaced from one another, each being responsive to the application of a transverse force;

a second support member having a top surface and a bottom surface;

a unitary conduction ply positioned on the bottom surface facing but transversely spaced from the plurality of first electrically isolated conductor segments, the second support member and the unitary conduction ply being resiliently deformable for deforming the unitary conduction ply into electrically contacting relationship with at least a selected one of the first electrically isolated conductor segments, the unitary conduction ply comprising:

a first conductive layer positioned on the bottom surface of the second support member, and a first semiconductor composition layer positioned on the first conductive layer for facing the plurality of first electrically isolated conductor segments; and a transverse spacer positioned laterally between each first electrically isolated conductor segment and transversely between the first and second support members for spacing the unitary conduction ply from the plurality of first electrically isolated conductor segments.

13. The multiple touch switch apparatus of claim 12 wherein the first semiconductor layer is pressure sensitive for providing a variable contact resistance in series with the touch switch apparatus in response to variations in the transverse force applied.

14. The multiple touch switch apparatus of claim 12 or 13 each first electrically isolated conductor segment comprising:

a second conductive layer positioned on the top surface of the first support member; and a second semiconductor composition layer positioned on the second conductive layer for facing the unitary conduction ply.

15. The multiple touch switch apparatus of claim 14 wherein the first and second semiconductor layers are pressure sensitive for providing a variable contact resistance in series with the touch switch apparatus in response to variations in the transverse force applied.

16. The multiple touch switch apparatus of claim 14 further comprising:

a first conductor ply affixed to the top surface of the second support member;

a third support member having a bottom surface;

a second conductor ply affixed to the bottom surface of the third support member, facing and transversely spaced from the first conductor ply, the third support member, and the second conductor ply being resiliently deformable for deforming the second conductor ply into electrical contacting relationship with the first conductor ply in response to the application of a transverse force and the third support ply.

17. A multiple touch switch apparatus for being selectively activated in response to the application of at least one transverse force comprising:

a first support member having a top surface;

a plurality of first electrically isolated conductor segments laterally displaced from one another, each being responsive to the application of a transverse force, each first electrically isolated conductor segment comprising:

a first conductive layer positioned on the top surface of the first support member, and a first semiconductor composition layer positioned on the first conductive layer;

a second support member having a top surface and a bottom surface;

a unitary conduction ply positioned on the bottom surface facing but transversely spaced from the plurality of first electrically isolated conductor segments, the second support member and the unitary conduction ply being resiliently deformable for selectively moving the unitary conduction ply into electrical contact with at least one of the first electrically isolated conductor segments in response to the application of the transverse force; and transverse spacer means positioned laterally between each first electrically isolated conductor segment and transpacing between the first and second support members for spacing the unitary conduction ply from the plurality of first electrically isolated conductor segments.

18. The multiple touch switch apparatus of claim 17 wherein the first semiconductor composition layer in pressure sensitive for providing a variable contact resistance in series with the touch switch apparatus in response to variations in the transverse force applied.

19. The multiple touch switch apparatus of claim 17 further comprising:

a first conductor ply affixed to the top surface of the second support member;

a third support member having a bottom surface;

a second conductor ply affixed to the bottom surface of the third support member, facing and transversely spaced from the first conductor ply, the third support member, and the second conductor ply being resiliently deformable for deforming the second conductor ply into electrical contacting relationship with the first conductor ply in response to the application of a transverse force against the third support ply.

* * * * *

UNITED STATES PATENT AND TRADEMARK OFFICE

CERTIFICATE OF CORRECTION

PATENT NO. : 4,276,538

DATED : June 30, 1981

INVENTOR(S) : Franklin N. Eventoff

It is certified that error appears in the above—identified patent and that said Letters Patent is hereby corrected as shown below:

Column 2, line 8, delete "having a to" and substitute --having to--.

Column 2, line 49, delete "partiual" and substitute --partial--.

Column 2, line 58, delete "invetion" and substitute --invention--

Column 3, line 29, delete "10°" and substitute --10--.

Column 4, line 49, delete "firstr" and substitute --first--.

Column 4, line 66, delete "abovedescribed" and substitute --above described--.

Column 5, line 37, delete "betwen" and substitute --between--.

Column 6, line 3, delete "cross-sectionted" and substitute --cross-sectioned--.

Column 6, line 4, delete "betwen" and substitute --between--.

UNITED STATES PATENT AND TRADEMARK OFFICE

CERTIFICATE OF CORRECTION

PATENT NO. : 4,276,538

DATED : June 30, 1981

INVENTOR(S) : Franklin N. Eventoff

It is certified that error appears in the above—identified patent and that said Letters Patent is hereby corrected as shown below:

Column 6, line 25, delete "smiconductor" and substitute --semiconductors--.

Column 10, line 47, delete "transpacing" and substitute --transversely--.

Column 10, line 52, delete "layer in" and substitute --layer is--.

Signed and Sealed this

*Twenty-third* Day of *March 1982*

[SEAL]

*Attest:*

GERALD J. MOSSINGHOFF

*Attesting Officer*

*Commissioner of Patents and Trademarks*